US006650303B2

(12) United States Patent
Kim et al.

(10) Patent No.: US 6,650,303 B2
(45) Date of Patent: Nov. 18, 2003

(54) CERAMIC CHIP ANTENNA

(75) Inventors: Hyun Jai Kim, Seoul (KR); Seok Jin Yoon, Seoul (KR); Ji Won Choi, Seoul (KR); Chong Yun Kang, Seoul (KR); Sung Hun Sim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 10/080,542

(22) Filed: Feb. 25, 2002

(65) Prior Publication Data

US 2002/0190906 A1 Dec. 19, 2002

(30) Foreign Application Priority Data

Jun. 15, 2001 (KR) ..... 2001-33969

(51) Int. Cl.[7] ..... H01Q 1/24
(52) U.S. Cl. ..... 343/895; 343/700 MS
(58) Field of Search ..... 343/895, 700 MS, 343/702, 823, 873, 846, 787, 788

(56) References Cited

U.S. PATENT DOCUMENTS 5,999,146 A * 12/1999 Kanba et al. ..... 343/895

* cited by examiner

*Primary Examiner*—James Clinger
(74) *Attorney, Agent, or Firm*—Greenblum & Bernstein, P.L.C.

(57) ABSTRACT

A ceramic chip antenna, which has a small size and a broad bandwidth, is provided. The ceramic chip antenna consists of a ceramic body with cuboid shape, a conductor wound helically inside the ceramic body, and signal-feed terminal formed on a surface of the ceramic body. The ceramic chip antenna with a helical conductor patterns formed in a symmetrical dipole shape is provided, which has a high gain value and excellent radiation characteristics. Also, it can be built-in inside a mobile terminal due to its small size. The ceramic chip antenna according to the present invention can have a broad bandwidth that satisfies the variable frequency of the present mobile communication system.

10 Claims, 5 Drawing Sheets

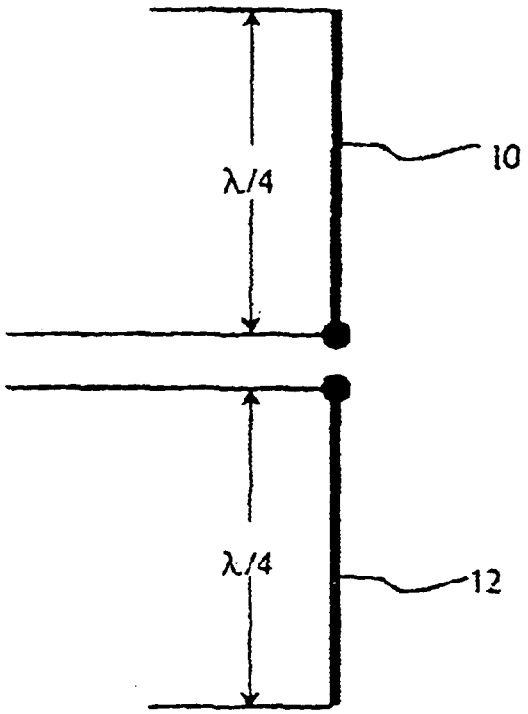
FIG. 1 PRIOR ART
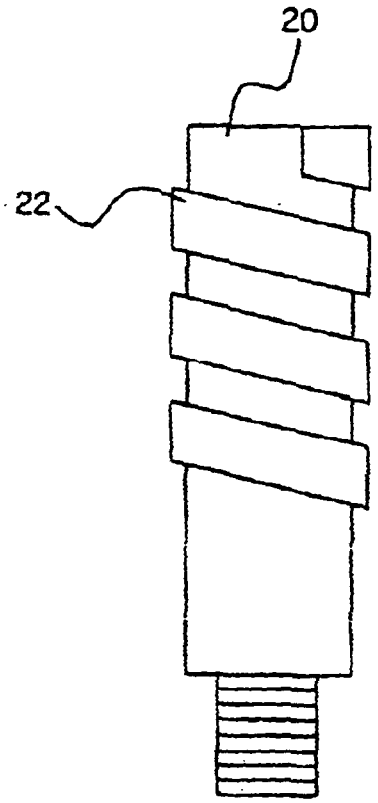
FIG. 2 PRIOR ART

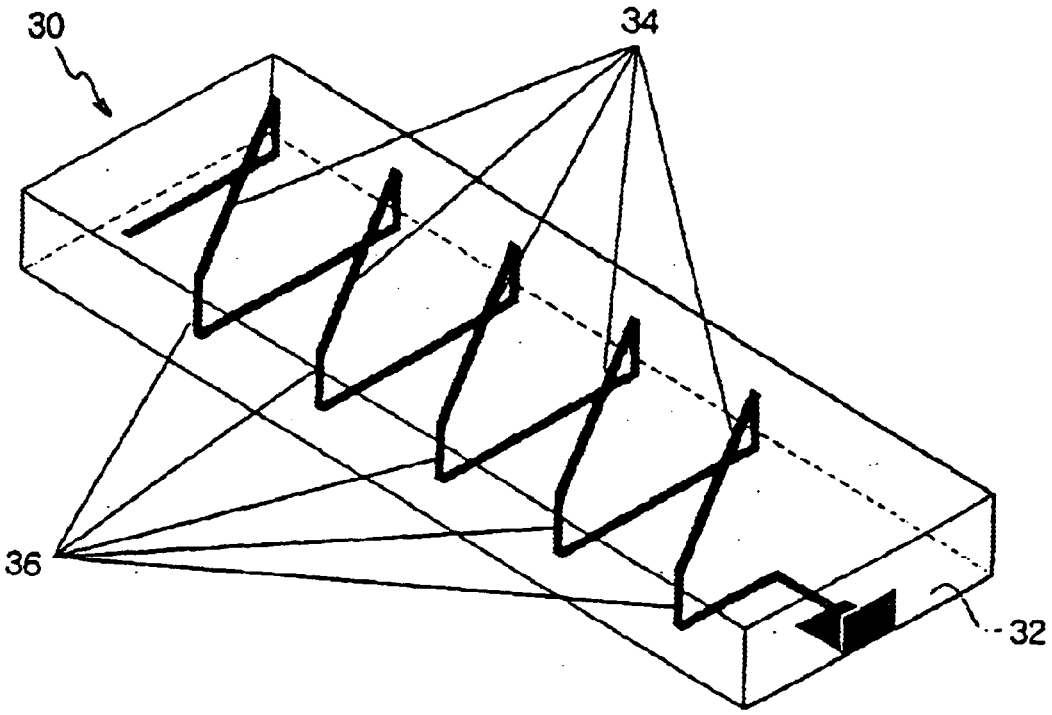
FIG. 3 PRIOR ART
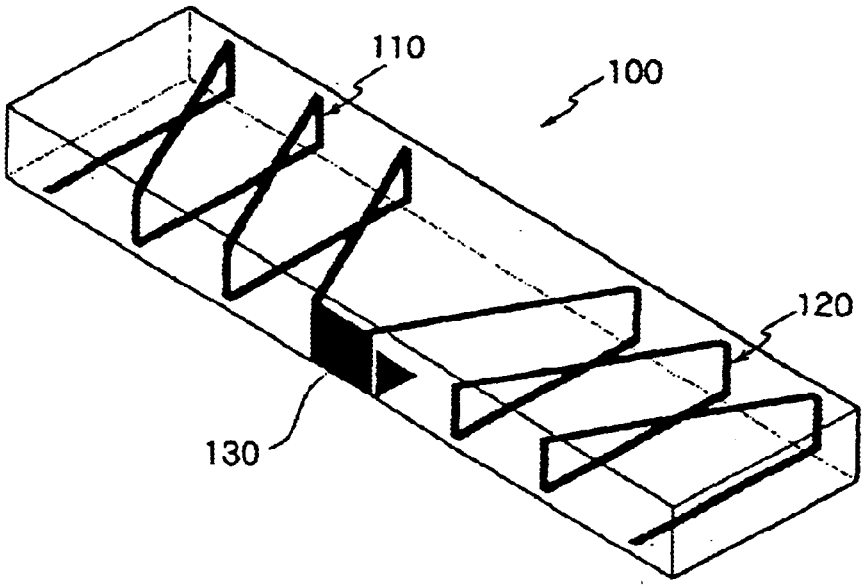
FIG. 4

CERAMIC CHIP ANTENNA

BACKGROUND OF THE INVENTION

The present invention relates to ceramic chip antennas. More particularly, the invention relates to a mobile communication terminal for transmitting and receiving high frequency signals and a surface mountable ceramic chip antenna terminal to be utilized for various wireless communications.

Conventionally, in order to accommodate the transmission and receiving frequency bands of a mobile communication system, a whip antenna that has a broad bandwidth was mainly used for a mobile phone.

However, the whip antenna takes up a large space and is liable to be broken due to its protruding shape from the mobile phone case. Also, along with the development towards a smaller and lighter mobile phone, the necessity has arisen for a small antenna that has a broad bandwidth but takes up a smaller space.

FIG. 1 shows a diagram of a conventional dipole antenna. As shown in FIG. 1, the conventional dipole antenna has a structure where two dipoles 10, 12 are connected together. The length of each dipole corresponds to ¼ of resonance frequency wavelength λ. This type of dipole antenna can easily be manufactured due to its simple structure and also has an advantage of being able to use in a broad frequency band. However, the applications of this type of antenna to a mobile terminal are not easy since it is not portable due to its long length.

FIG. 2 shows a diagram of a conventional helical antenna. As shown in FIG. 2, the conventional helical antenna has a shape where a length of wire 22 is wound around a base rod 20. This is to determine the resonance frequency band by adjusting the number of windings and the space between each winding. This type of helical antenna can be adapted to a mobile terminal since the total length of the antenna is shorter than that of the dipole antenna.

FIG. 3 shows a projection diagram of a ceramic chip antenna. As shown in FIG. 3, a spiral shape helical conductor is included in the conventional ceramic chip antenna structure. The helical conductor comprises a horizontal strip line 34 which is printed in parallel with the lower face 32 and a vertical strip wire 36 formed by conducting paste which fills in a via hole which was vertically formed on the lower face.

The development of this type of ceramic chip antenna 30 has progressed up to a stage where it can be built-in inside a mobile terminal; however, the problem of not being able to perform various types of wireless communication services due to its narrow frequency bandwidth still remains.

SUMMARY OF THE INVENTION

The object of the present invention is to reinforce the weakness of a whip antenna by forming a helical conductor in the shape of a dipole structure inside of a ceramic chip as well as to improve the gain, radiation and bandwidth characteristics of the antenna.

Another object of the present invention is to provide a ceramic chip antenna with broadband characteristics which can be built-in inside of a mobile terminal by minimizing the size of the antenna using a helical conductor or high permittivity dielectrics.

In order to achieve the stated objects above, the ceramic chip antenna according to the present invention comprises a main body 100 in which first, second and third dielectric body sheets 100*a*, 100*b*, 100*c* are laminated, first and second horizontal metallic patterns 112, 114 formed on the inner upper face of the main body 100, third and fourth horizontal metallic patterns 116, 118 formed on the inner lower face of the main body 100, and first, second, third and fourth vertical metallic patterns 122, 124, 126, 128 formed on the side face of the main body 100 which connects the first and second horizontal metallic patterns 112, 114 and the third and fourth horizontal metallic patterns 116, 118.

BRIEF DESCRIPTION OF THE DRAWINGS

FIG. 1 shows a diagram of a conventional dipole antenna.

FIG. 2 shows a diagram of a conventional helical antenna.

FIG. 3 shows a projection diagram of a ceramic chip antenna.

FIG. 4 shows a projection diagram of the ceramic chip antenna according to the present invention.

DETAILED DESCRIPTION OF THE EMBODIMENTS

Hereinafter, preferred embodiments of the present invention will be described in detail with reference to the accompanying drawings.

FIG. 4 shows a projection diagram of the ceramic chip antenna according to the present invention.

Figure 5:
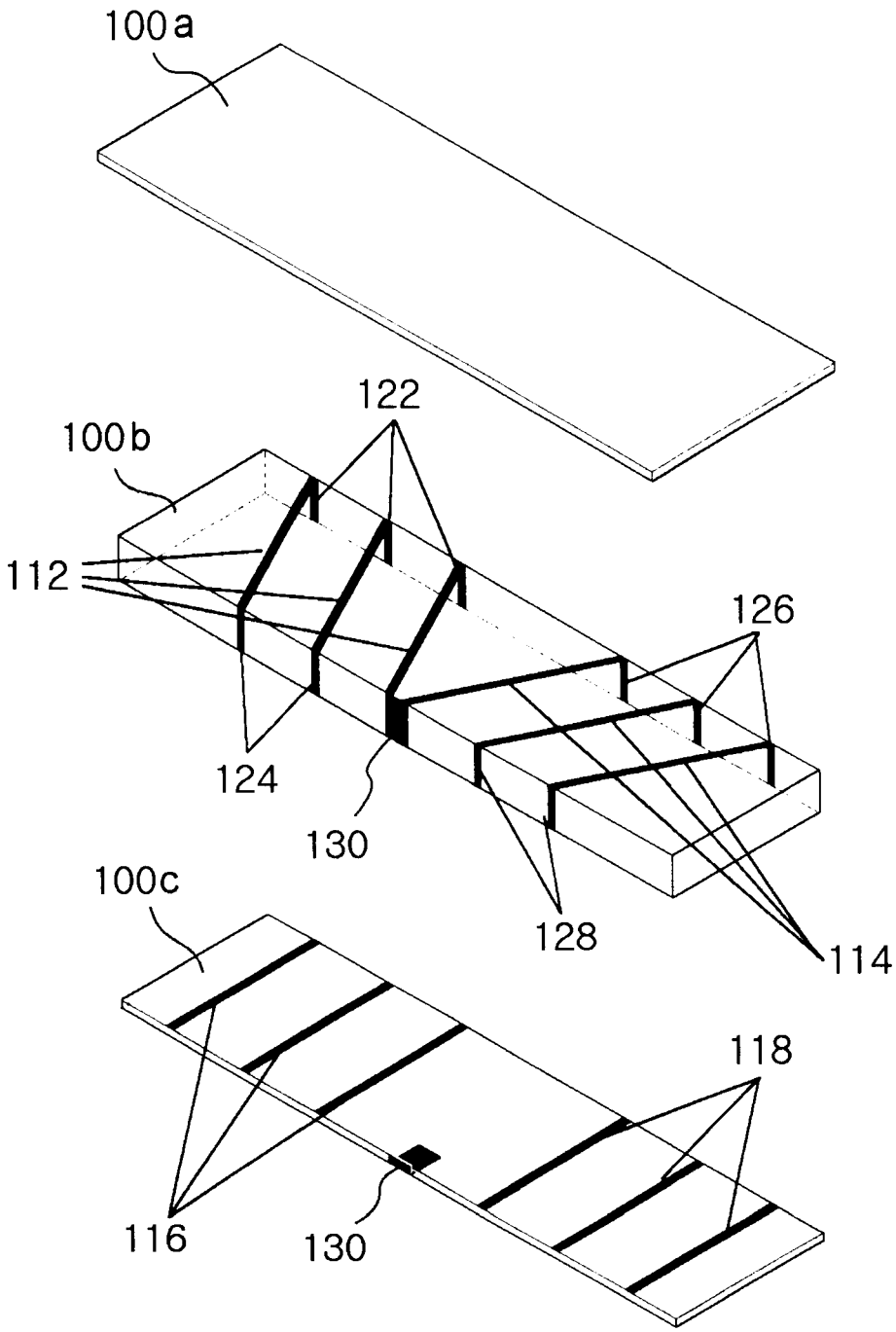
FIG. 5 shows an exploded projection diagram of the ceramic chip antenna as illustrated in FIG. 4.

FIG. 5 shows an exploded projection diagram of the ceramic chip antenna as illustrated in FIG. 4.

The ceramic chip antenna as illustrated in FIG. 4 comprises a ceramic chip main body 100 in a cuboid shape in which dielectric ceramic green sheets 100*a*, 100*b*, 100*c* are laminated, and a first helical conductor 110 and a second helical conductor 120, which are formed in a spiral shape inside of the ceramic chip main body 100, are formed against a feeder section 130 in a symmetrical dipole shape.

As illustrated in FIG. 5, the first, second, third and fourth vertical metallic patterns 122, 124, 126, 128 formed on an external side face of the dielectric sheet in order to improve the radiation characteristics of the antenna as well as to accommodate an easy connection between the first and second horizontal metallic patterns 112, 114 and the third and fourth horizontal metallic patterns 116, 118.

In this instance, the first, second, third and fourth horizontal metallic patterns 112, 114, 116, 118 and the first, second, third and fourth vertical metallic patterns 122, 124, 126, 128 represent metal strip lines.

Also, the feeder section 130 of the ceramic chip antenna can be designed to be surface mounted by extracting it to the side face of the dielectric sheets 100*b*, 100*c*.

With tune by the thickness between the upper dielectric sheet 10*a* and the lower dielectric sheet 100*c* of the main body 100, this thickness value acts as a control parameter which controls the capacitive coupling between parallel metallic patterns, and the ground plane and the free space and then possibly controls the center frequency.

Also, the ceramic dielectric chip is manufactured through a ceramic chip process that involves laminating a plurality of green sheets. One end of the helical conductor protrudes outside of the ceramic dielectric chip in order to form a voltage supply terminal. Voltage is applied to the end of the helical conductors through this voltage terminal.

Figure 6:
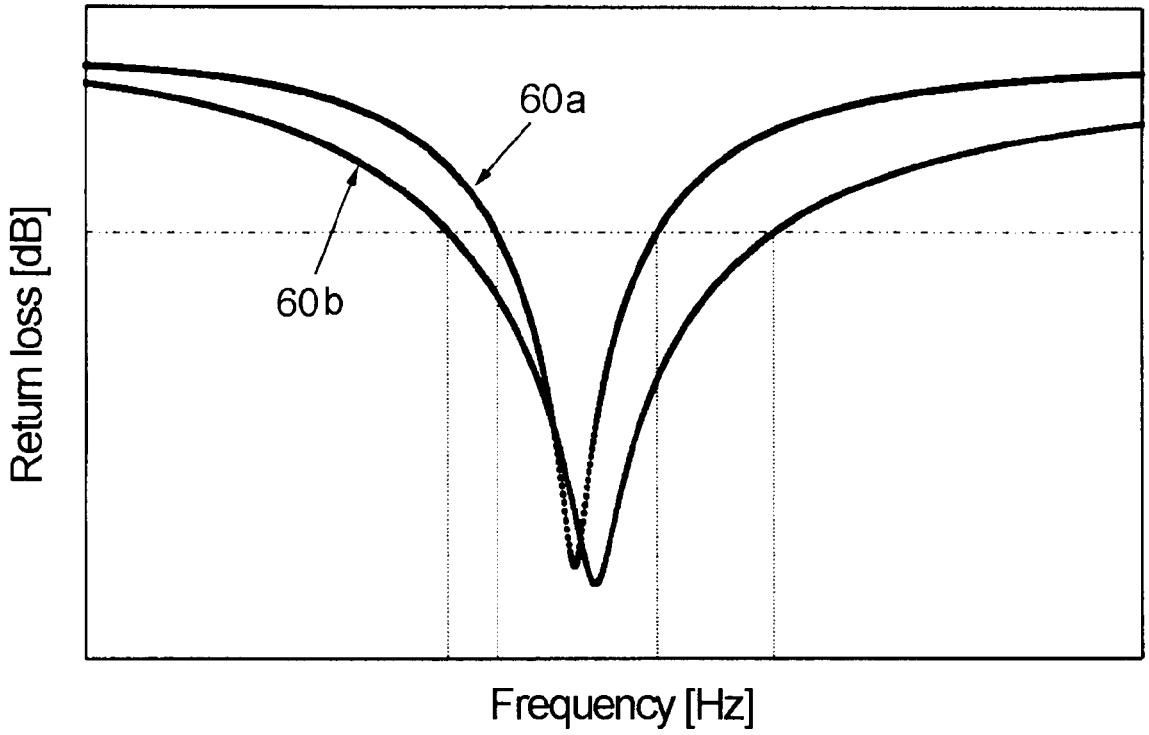
FIG. 6 represents the comparison of return loss characteristics of the ceramic chip antenna 60*a* in the present invention with the conventional antenna as shown in FIG. 3.

FIG. 6 represents the return loss characteristics of the conventional ceramic chip antenna 60*a* as shown in FIG. 3 and the ceramic chip antenna 60*b* according to the present invention. The ceramic chip antenna 60*b* according to the present invention can obtain a high gain value and excellent radiation characteristics by forming helical conductor patterns in a symmetrical dipole shape.

Figure 7:
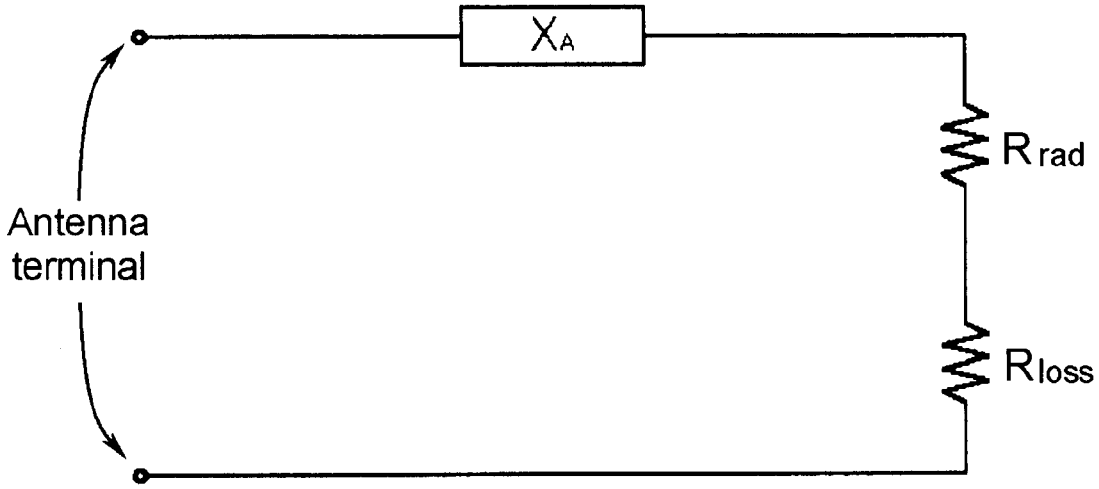
FIG. 7 shows a general equivalent circuit diagram of a small antenna.

FIG. 7 shows a general equivalent circuit diagram of a small antenna. As shown in Mathematical Equation 1, the input impedance ZA is consisted of an input resistance RA and an input reactance XA.

Also, the input resistance RA means voltage 20 consumption and it occurs mainly due to two reasons as shown in Mathematical Equation 2. One is the radiation resistance Rrad which represents the radiation of the antenna and the other is the heat related loss resistance Rloss in the antenna structure.

$$ZA=RA+jXA \quad \text{[Mathematical Equation 1]}$$

$$RA=Rrad+Rloss \quad \text{[Mathematical Equation 2]}$$

(ZA: input impedance, RA: input resistance, XA: input reactance, Rrad: radiation resistance, Rloss: loss resistance)

As can be seen from the equations above, the radiation patterns and directivity are independent from the size of the antenna or frequency; however, the radiation resistance and reactance are different. The small antenna has a much smaller radiation resistance value than the reactance value, hence, it gets a very high Q value as shown in Mathematical Equation 3. Also, the bandwidth of the antenna decreases since it is inversely proportional to the Q value as shown in Mathematical Equation 4.

$$Q=XA/RA \quad \text{[Mathematical Equation 3]}$$

$$Q=fr/\Delta f \quad \text{[Mathematical Equation 4]}$$

(Q: Quality Parameter, Δf: Mean Frequency)

According to the present invention, a dipole structure antenna which can increase the values of the input resistance RA and radiation resistance Rrad is implemented through a spiral conductor in order to improve the narrow bandwidth of the conventional ceramic chip antenna in FIG. 3 due to its high Q value.

Generally, if a single winding length of the spiral loop becomes much shorter than the used wavelength, then the main beam tends to form in the vertical direction against the axis. This antenna is called a normal-mode helical antenna (NMHA).

Since the normal-mode helical antenna is wound in a spiral shape similar to a spring, the rout through which current can flow is equivalent to the actual length of the spiral therefore the rout can be significantly longer than it appears. As a result, the helical antenna has a very good radiation resistance value.

The radiation resistance increases proportionally with respect to a square of the increased antenna length up to a wavelength. However, if the increase in the antenna length exceeds a wavelength, then the radiation resistance decreases. For this reason, the number of windings and the winding radius can not be increased indefinitely.

Figure 8A:
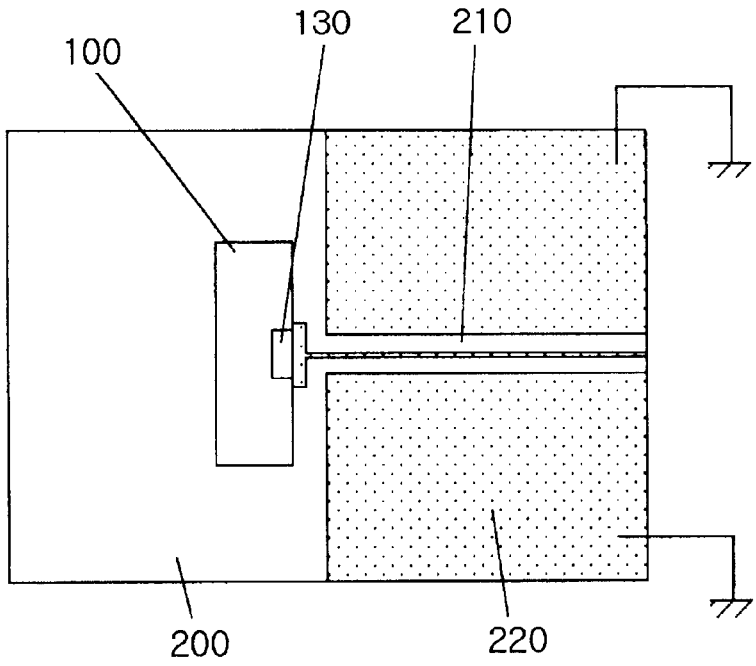
FIGS. 8*a* and 8*b* are plane diagrams of the upper sheet (FIG. 8) and lower sheet (FIG. 8*b*) of the ceramic chip antenna 200 with a Coplanar Waveguide (CPW) structure (210) according to one embodiment of the present invention.
Figure 8B:
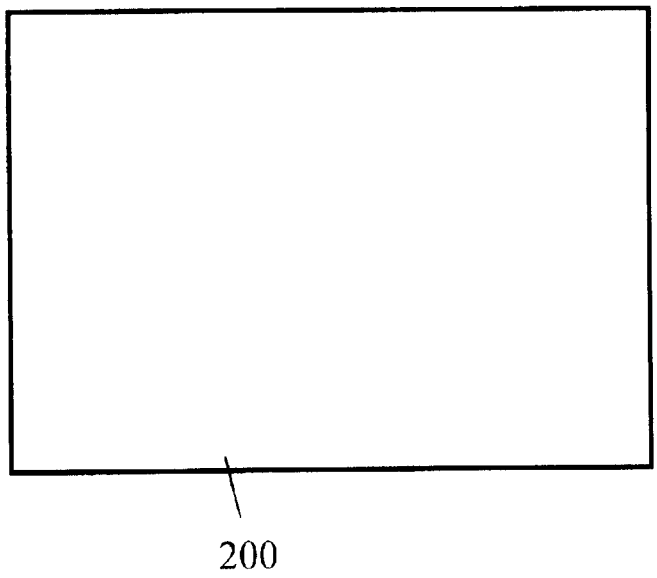

FIGS. 8*a* and 8*b* are plane diagrams of the upper sheet (FIG. 8) and lower sheet (FIG. 8*b*) of the ceramic chip antenna 200 with a Coplanar Waveguide (CPW) structure (210) according to one embodiment of the present invention. This type of structure reduces the excessive coupling between ground plane (220) and ceramic dielectric chip (100).

As explained so far, the present invention provides a ceramic chip antenna with a helical conductor patterns formed in a symmetrical dipole shape which has a high gain value and excellent radiation characteristics. Also, it can be built-in inside a mobile terminal due to its small size.

The ceramic chip antenna according to the present invention can have a broad bandwidth that satisfies the variable frequency of the present mobile communication system and using a surface mounted antenna instead of a whip antenna can reduce the size of the mobile terminal.

The following is a detailed explanation through examples of the invention. It should be understood, however, that the detailed description and specific examples are given by way of illustration only, since various changes and modifications within the spirit and scope of the invention will become apparent to those skilled in the art from this detailed description.

What is claimed is:

1. A ceramic chip antenna, comprising:

main body comprising first, second and third laminated dielectric body sheets;

first and second horizontal metallic patterns formed on an inner face of the second dielectric body sheet;

third and fourth horizontal metallic patterns formed on an inner face of the third dielectric body sheet, the third and fourth horizontal metallic patterns respectively corresponding to the first and second horizontal metallic patterns; and first, second, third and fourth vertical metallic patterns formed on external side faces of the main body, the first, second, third and fourth vertical metallic patterns connecting the first and second horizontal metallic patterns and the corresponding third and fourth horizontal metallic patterns.

2. The ceramic chip antenna as claimed in claim 1, further comprising a feeder section configured to be surface mounted to the a side face of at least one of the dielectric sheets.

3. The ceramic chip antenna as claimed in claim 1, wherein the first, second, third and fourth vertical metallic patterns are configured to form a symmetrical dipole shape against a feeder section.

4. The ceramic chip antenna as claimed in claim 1, wherein a center frequency of the antenna corresponds to a thickness between the first dielectric sheet and the third dielectric sheet.

5. A ceramic chip dipole antenna, comprising:

a main body comprising a plurality of dielectric sheets configured in a substantially vertical arrangement;

a first plurality of metallic patterns formed on horizontal surfaces of at least one dielectric sheet, the horizontal surfaces being internal to the main body; and a second plurality of metallic patterns formed on vertical surfaces of at least one dielectric body sheet, the vertical surfaces coinciding with at least a portion of external surfaces of the main body, the second plurality of metallic patterns connecting the first plurality of metallic patterns to form the dipole antenna.

6. The ceramic chip dipole antenna as claimed in claim 5, further comprising a feeder section configured to be surface mounted to at least one of the vertical surfaces of the at least one dialectic body sheet.

7. The ceramic chip dipole antenna as claimed in claim 6, wherein the second plurality of metallic patterns connect the first plurality of metallic patterns to form a symmetrical dipole shape against the feeder section.

8. The ceramic chip dipole antenna as claimed in claim 5, wherein a center frequency of the dipole antenna is based on a thickness between two outermost dielectric sheets.

9. The ceramic chip dipole antenna as claimed in claim 5, wherein the dipole antenna, formed by the first and second pluralities of metallic patterns, has a helical conductor pattern.

10. A symmetrical dipole antenna, comprising:

a main body of a ceramic chip comprising a plurality of laminated dielectric sheets;

a first plurality of metallic patterns provided on surfaces of the dielectric sheets internal of the main body;

a second plurality of metallic patterns provided on surfaces of the dielectric sheets external of the main body, the second plurality of metallic patterns connecting the first plurality of metallic patterns to form a helical pattern.

* * * * *

UNITED STATES PATENT AND TRADEMARK OFFICE

CERTIFICATE OF CORRECTION

PATENT NO. : 6,650,303 B2
DATED : November 18, 2003
INVENTOR(S) : Kim et al.

It is certified that error appears in the above-identified patent and that said Letters Patent is hereby corrected as shown below:

Column 4,
Line 31, before “main” insert -- a --.

Column 5,
Line 7, “dialectic” should be -- dielectric --.

Signed and Sealed this

Twenty-second Day of June, 2004

JON W. DUDAS
*Acting Director of the United States Patent and Trademark Office*